US011585520B1

(12) United States Patent
Lu et al.

(10) Patent No.: US 11,585,520 B1
(45) Date of Patent: Feb. 21, 2023

(54) HIGH-DURABILITY TRI-PROOF LAMP WITH COLOR TEMPERATURE ADJUSTMENT FUNCTION

(71) Applicant: Xiamen PVTECH Co., Ltd., Fujian (CN)

(72) Inventors: Fuxing Lu, Fujian (CN); Rongtu Liu, Fujian (CN); Chun Ming Liu, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/571,517

(22) Filed: Jan. 9, 2022

(30) Foreign Application Priority Data

Nov. 29, 2021 (CN) ..... 202111433163.5

(51) Int. Cl.

| | |
|---|---|
| ***F21V 23/00*** | (2015.01) |
| ***F21V 15/015*** | (2006.01) |
| ***F21V 31/00*** | (2006.01) |
| ***F21V 21/34*** | (2006.01) |
| ***H05B 45/20*** | (2020.01) |
| *F21Y 115/10* | (2016.01) |
| *F21Y 103/10* | (2016.01) |

(52) U.S. Cl.
CPC ..... *F21V 23/005* (2013.01); *F21V 15/015* (2013.01); *F21V 21/34* (2013.01); *F21V 31/00* (2013.01); *H05B 45/20* (2020.01); *F21Y 2103/10* (2016.08); *F21Y 2115/10* (2016.08)

(58) Field of Classification Search
CPC ..... F21V 23/005; F21V 15/015; F21V 31/00; H05B 45/20; F21Y 2103/10
See application file for complete search history.

(56) References Cited

FOREIGN PATENT DOCUMENTS

DE 2014108898 A1 * 12/2014

* cited by examiner

*Primary Examiner* — Anabel Ton
(74) *Attorney, Agent, or Firm* — Winston Hsu

(57) ABSTRACT

A high-durability tri-proof lamp with color temperature adjustment function is provided, which includes a lamp housing, a movable support plate, a circuit board and a driving power source. The lamp housing has two connection holes and a guiding groove. The lamp housing is hollow and has a chamber; the connection holes are disposed at the two ends of the lamp housing. The guiding groove includes two lateral guiding slots disposed at the two sides of the chamber. The movable support plate is disposed in the chamber. One side of the movable support plate and the other side thereof are inserted into the lateral guiding slots, such that the movable support plate is able to move along the guiding groove. The circuit board is disposed in the chamber and connected to the movable support plate. The driving power source is disposed on and electrically connected to the circuit board.

9 Claims, 7 Drawing Sheets

HIGH-DURABILITY TRI-PROOF LAMP WITH COLOR TEMPERATURE ADJUSTMENT FUNCTION

BACKGROUND OF THE INVENTION

1. Field of the Invention

The present invention relates to a tri-proof lamp, in particular to a high-durability tri-proof lamp with color temperature adjustment function, and easy to maintain and repair.

2. Description of the Prior Art

Generally speaking, the environments of some places, such as factories, mines, etc., are extremely bad, so these places need tri-proof lamps having water-proof function, dust-proof function and corrosion-proof function. Some places need to be installed with a large number of tri-proof lamps in order to conform to the requirements thereof.

However, the color temperatures of currently available tri-proof lamps cannot be adjusted, so one type of tri-proof lamp products can provide only one color temperature. Besides, currently available tri-proof lamps are expensive and occupy a lot of space. However, the manufacturers and distributors still need to prepare a lot of stocks of tri-proof lamps having different color temperatures, which occupies a lot of warehouses and incurs high cost. In order to solve the above problems, the embodiments of the present invention provide a high-durability tri-proof lamp with color temperature adjustment function. The user can adjust the color temperature of the tri-proof lamp according to the user manual of this product. Thus, the manufacturer of the tri-proof lamp can satisfy different requirements by providing only one type of products.

SUMMARY OF THE INVENTION

The present invention is related to a high-durability tri-proof lamp with color temperature adjustment function. In one embodiment of the present invention, the high-durability tri-proof lamp with color temperature adjustment function includes a lamp housing, a movable support plate, a circuit board and a driving power source. The lamp housing has two connection holes and a guiding groove. The lamp housing is hollow and a chamber is formed therein; the connection holes are disposed at the two ends of the lamp housing respectively. The guiding groove includes two lateral guiding slots disposed at the two sides of the chamber respectively. The movable support plate is disposed in the chamber. One side of the movable support plate and the other side of the movable support plate are inserted into the lateral guiding slots respectively, such that the movable support plate is able to move along the guiding groove. The circuit board is disposed in the chamber and connected to the movable support plate. The driving power source is disposed on the circuit board and electrically connected to the circuit board.

In one embodiment, the high-durability tri-proof lamp further includes a light source board electrically connected to the circuit board and disposed in the chamber.

In one embodiment, the high-durability tri-proof lamp further includes a color temperature adjustment switch disposed in the chamber and electrically connected to the light source board.

In one embodiment, the high-durability tri-proof lamp further includes a light diffuser covering at least a portion of the lamp housing, such that the light emitted by one or more light-emitting elements of the light source board passes through the light diffuser and the lamp housing.

In one embodiment, the high-durability tri-proof lamp further includes a light reflecting plate disposed in the chamber and the light source board is fixed on the light reflecting plate.

In one embodiment, the circuit board is fixed to the movable support plate via a fixing element.

In one embodiment, the circuit board has a color temperature switching circuit, and the color temperature switching circuit includes a first light source, a second light source, a switch, a positive electrode and a negative electrode. One end of the first light source and one end of the second light source are connected to the positive electrode, and the other end of the first light source and the other end of the second light source are connected to the switch. The switch is switched between a first state and a second state to connect the other end of the first light source to the negative electrode or connect the other end of the second light source to the negative electrode.

In one embodiment, the circuit board has four protrusion portions, such that the circuit board is I-shaped. The tips of the protrusion portions are rounded and the protrusion portions are inserted into the lateral guiding slots respectively.

In one embodiment, the high-durability tri-proof lamp further includes a connector disposed on the movable support plate and electrically connected to the circuit board. The connector is electrically connected to an external power source.

In one embodiment, the high-durability tri-proof lamp further includes two removable water-proof caps disposed on the lamp housing and covering the connection holes respectively.

The high-durability tri-proof lamp with color temperature adjustment function in accordance with the embodiments of the present invention may have the following advantages:

(1) In one embodiment of the present invention, the lamp housing of the tri-proof lamp is integrated with a movable support plate and a guiding groove. The integrated structure design allows the user to pull a circuit board mounting a driving power source from the lamp housing, such that the driving power source can be moved out of the lamp housing. Thus, the user can conveniently maintain or repair the tri-proof lamp in order to significantly increase the durability (service life) of the tri-proof lamp. Accordingly, the quantities of garbage and the cost can be greatly reduced with a view to conform to the requirements of environmental protection.

(2) In one embodiment of the present invention, the tri-proof lamp can be easily assembled and disassembled without special tools, so the user can conveniently assemble and disassemble the tri-proof lamp by his/her hands in order to maintain or repair the tri-proof lamp. Therefore, the tri-proof lamp can be conveniently maintained and repaired.

(3) In one embodiment of the present invention, the tri-proof lamp has a color temperature adjustment switch, so the user can adjust the color temperature of the light-emitting elements of the light source board via the color temperature adjustment switch. Thus, the tri-proof lamp can provide various color temperatures in order to enhance the function of the tri-proof lamp, so the application of the tri-proof lamp can be more comprehensive.

(4) In one embodiment of the present invention, the circuit board, mounting the driving power source, of the tri-proof lamp is I-shaped and the tips of the four protrusion portions of the I-shaped circuit board are rounded, such that the contact area between the circuit board and the guiding groove can be greatly decreased, which can effectively prevent the materials on the circuit board adhered to the guiding groove.

(5) In one embodiment of the present invention, the structure design of the tri-proof lamp is simple and effective, so can achieve the desired technical effects without significantly increasing the cost. Therefore, the tri-proof lamp can have high commercial value.

These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will become more fully understood from the detailed description given herein below and the accompanying drawings which are given by way of illustration only, and thus are not limitative of the present invention and wherein.

DETAILED DESCRIPTION

Figure 1:
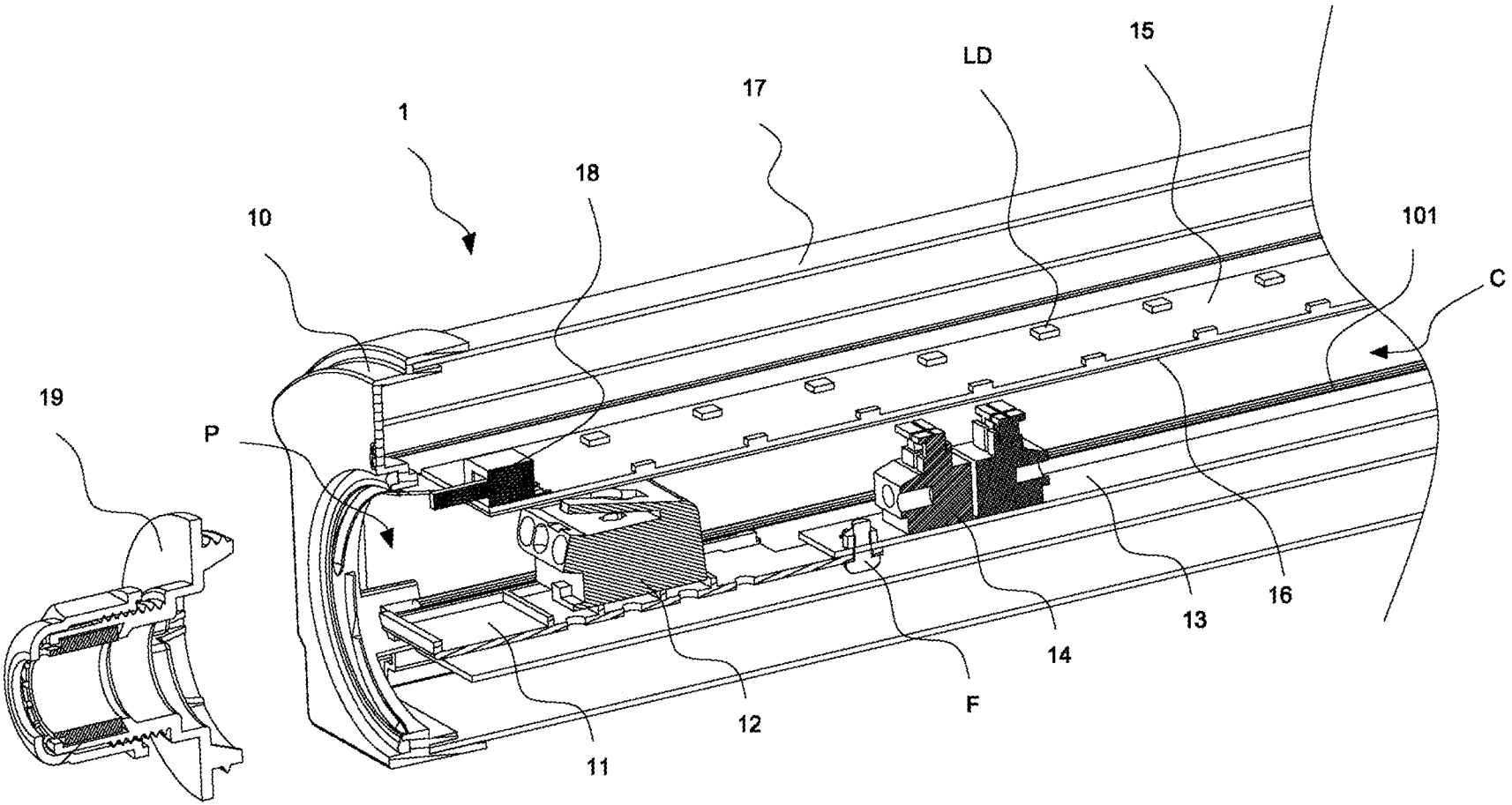
FIG. 1 is a first cross-sectional view of a high-durability tri-proof lamp with color temperature adjustment function in accordance with one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing. It should be understood that, when it is described that an element is "coupled" or "connected" to another element, the element may be "directly coupled" or "directly connected" to the other element or "coupled" or "connected" to the other element through a third element. In contrast, it should be understood that, when it is described that an element is "directly coupled" or "directly connected" to another element, there are no intervening elements.

Figure 2:
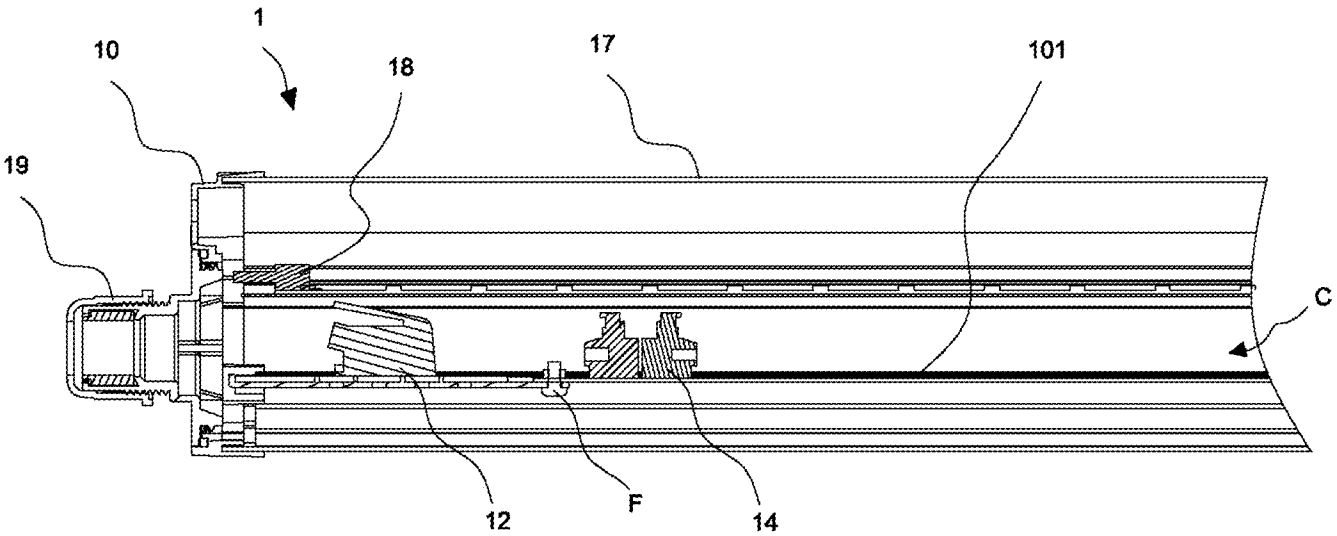
FIG. 2 is a second cross-sectional view of the high-durability tri-proof lamp with color temperature adjustment function in accordance with one embodiment of the present invention.

Please refer to FIG. 1 and FIG. 2, which are a first cross-sectional view and a second cross-sectional view of a high-durability tri-proof lamp with color temperature adjustment function in accordance with one embodiment of the present invention. As shown in FIG. 1 and FIG. 2, the tri-proof lamp 1 includes a lamp housing 10, a movable support plate 11, a connector 12, a circuit board 13, a driving power source 14, a light source board 15, a light reflecting plate 16, a light diffuser 17, a color temperature adjustment switch 18 and two removable water-proof caps 19.

The lamp housing 10 has two connection holes P (since FIG. 1 shows only the cross-section of a portion of the tri-proof lamp 1, there is only one connector hole P in FIG. 1) and a guiding groove. The lamp housing 10 is hollow, so a chamber C is formed inside the lamp housing 1. The connection holes P are disposed at the two ends of the lamp housing 10 respectively. The guiding groove includes two lateral guiding slots 101 and the lateral guiding slots 101 are disposed at the two sides of the chamber C. in one embodiment, the lateral guiding slots 101 may be U-shaped slots. In another embodiment, the lateral guiding slots 101 may have other similar structures.

The movable support plate 11 is disposed in the chamber C. One side of the movable support plate 11 is inserted in one of the lateral guiding slots 101 and the other side of the movable support plate 11 is inserted into the other one of the lateral guiding slots 101. Thus, the movable support plate 11 can move along the guiding groove.

The connector 12 is disposed on the movable support plate 11 and electrically connected to the circuit board 13 in order to connect to an external power source. The user can connect the external power source to the connector 12 via a cable in order to swiftly finish the installation of the tri-proof lamp 11.

The circuit board 13 is disposed in the chamber C and connected to the movable support plate 11. The driving power source 14 is disposed on the circuit board 13 and electrically connected to the circuit board 13. The circuit board 13 is fixed to the movable support plate 11 via a fixing element F. The user can remove the fixing element F to maintain or repair the tri-proof lamp 1 or replace the part(s) of the tri-proof lamp 1 by his/her hands. Then, the user can also re-install the fixing element F by his/her hands. In one embodiment, the fixing element F may be, but not limited to, a dowel made of metal, plastics or other similar materials. In another embodiment, the fixing element F may also be a long cylindrical element or other similar elements.

Figure 3:
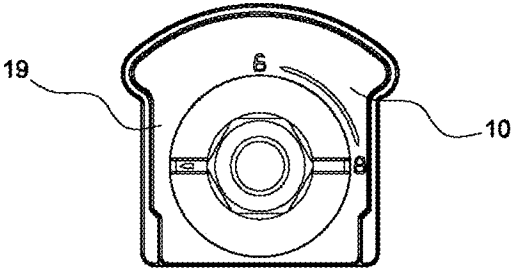
FIG. 3 is a front view of the high-durability tri-proof lamp with color temperature adjustment function in accordance with one embodiment of the present invention.

Please refer to FIG. 3, which is a front view of the high-durability tri-proof lamp with color temperature adjustment function in accordance with one embodiment of the present invention. Please also refer to FIG. 1 and FIG. 2. As shown in FIG. 1, FIG. 2 and FIG. 3, the removable water-proof caps 19 are disposed on the lamp housing 10. The removable water-proof caps 19 can be detachably disposed at the connection holes P of the two ends of the lamp housing 10 respectively so as to cover the connection holes P respectively. The removable water-proof caps 19 can have male thread and the connection holes P of the lamp housing 10 can have female thread. Therefore, the user can manually rotate the removable water-proof caps 19 in order to install or remove the removable water-proof caps 19. The above connection structure is just for illustration; the connection structure between the removable water-proof caps 19 and the lamp housing 10 can be changed according to actual requirements.

As shown in FIG. 1 and FIG. 2, when the user installs the tri-proof lamp 1, the user can manually remove the removable water-proof cap 19 adjacent to the movable support plate 11 and then pull the movable support plate 11 from the lamp housing 10 so as to move the connector 12 out of the lamp housing 10. Afterward, the user can connect the connector 12 to the external power source in order to achieve the electrical connection. Besides, when the driving power source 14 malfunctions after the tri-proof lamp 1 has been used for a long time, the user can manually remove the removable water-proof caps 19 and put the movable support plate 11 from the lamp housing 10 so as to move the driving power source 14 out of the lamp housing 10. In this way, the user can repair or replace the driving power source 14. Similarly, the user can repair or replace other parts of the tri-proof lamp 1 by the same way. As a result, the user can conveniently maintain the tri-proof lamp 1 with a view to increase the durability (service life) of the tri-proof lamp 1.

The light source 15 is electrically connected to the circuit board 13 and disposed in the chamber C. The light source board 15 is provided with one or more light-emitting elements LD, which may be light-emitting diodes (LEDs) or other currently available light sources. The light reflecting plate 16 is disposed in the chamber C and the light source board 15 is disposed on the light reflecting plate 16, such that the light reflecting plate 16 can effectively fix the light source board 15. In this way, the light reflecting plate 16 can effectively provide heat dissipation assistance function and light reflecting function.

The light diffuser 17 covers at least a portion of the lamp housing 10, such that the light emitted by the light-emitting element(s) LD of the light source board 15 can pass through the light diffuser 17 and the lamp housing 10 in order to achieve excellent light diffusing effect.

The color temperature adjustment switch 18 is disposed in the chamber C and electrically connected to the light source board 15. The color temperature adjustment switch 18 can be used to adjust the color temperature of the light-emitting element(s) of the light source board 15. Accordingly, the user can adjust the color temperature of the light-emitting element(s) of the light source board 15 via the color temperature adjustment switch 18. In this way, the user can change the color temperature of the tri-proof lamp 1 according to his/her needs, so the functionality of the tri-proof lamp 1 can be enhanced and the tri-proof lamp 1 can be more comprehensive in application.

The embodiment just exemplifies the present invention and is not intended to limit the scope of the present invention; any equivalent modification and variation according to the spirit of the present invention is to be also included within the scope of the following claims and their equivalents.

It is worthy to point out that some parts of currently available tri-proof lamps may be damaged or malfunction, such that these lamps may not operate normally and the service lives thereof are also reduced. For the reason, the user may need to replace a lot of lamps once every three or five years and discard these damaged lamps, which wastes a lot of natural resources and produce a large amount of garbage. Thus, currently available tri-proof lamps cannot satisfy the requirements of environmental protection. On the contrary, according to one embodiment of the present invention, the lamp housing of the tri-proof lamp is integrated with a movable support plate and a guiding groove. The integrated structure design allows the user to pull a circuit board mounting a driving power source from the lamp housing, such that the driving power source can be moved out of the lamp housing. Thus, the user can conveniently maintain or repair the tri-proof lamp in order to significantly increase the durability (service life) of the tri-proof lamp. Accordingly, the quantities of garbage and the cost can be greatly reduced with a view to conform to the requirements of environmental protection.

In addition, according to one embodiment of the present invention, the tri-proof lamp has a color temperature adjustment switch, so the user can adjust the color temperature of the light-emitting elements of the light source board via the color temperature adjustment switch. Thus, the tri-proof lamp can provide various color temperatures in order to enhance the function of the tri-proof lamp, so the application of the tri-proof lamp can be more comprehensive.

Besides, according to one embodiment of the present invention, the tri-proof lamp can be easily assembled and disassembled without special tools, so the user can conveniently assemble and disassemble the tri-proof lamp by his/her hands in order to maintain or repair the tri-proof lamp. Therefore, the tri-proof lamp can be conveniently maintained and repaired. As set forth above, the tri-proof lamp according to the embodiments of the present invention can achieve great technical effects.

Figure 4:
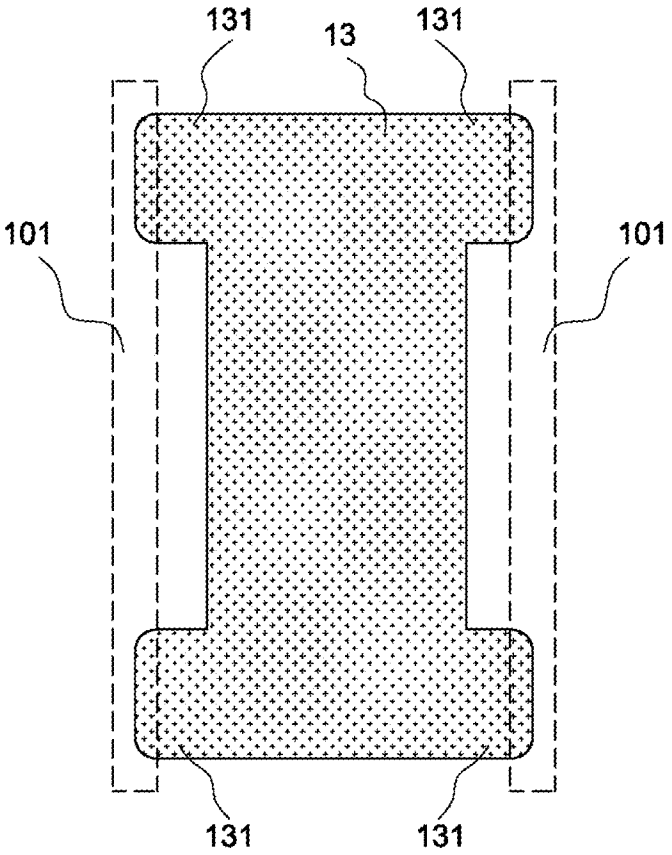
FIG. 4 is a top view of a circuit board of the high-durability tri-proof lamp with color temperature adjustment function in accordance with one embodiment of the present invention.

Please refer to FIG. 4, which is a top view of a circuit board of the high-durability tri-proof lamp with color temperature adjustment function in accordance with one embodiment of the present invention. As shown in FIG. 4, the circuit board 13 may be I-shaped (similar to the uppercase letter "I"), such that the circuit board 13 has four protrusion portions 131. In addition, the tips of the protrusion portions 131 can be processed to be rounded and the protrusion portions 131 are inserted into the lateral guiding slots 101 respectively. After the tri-proof lamp 1 has been used for a period of time, the materials on the circuit board 13 tend to be adhered to the guiding groove (including the lateral guiding slots 101). If the above condition occurs, the circuit board 13 may be difficult to move along the guiding groove or cannot move along the guiding groove. The circuit board 13 is designed to be I-shaped in order to greatly decrease the contact area between the circuit board 13 and the guiding groove, which can effectively prevent the materials on the circuit board 13 from being adhered to the guiding groove. Moreover, the rounded tips of the protrusion portions 131 make the circuit board 13 can more smoothly move along the guiding groove.

The embodiment just exemplifies the present invention and is not intended to limit the scope of the present invention; any equivalent modification and variation according to the spirit of the present invention is to be also included within the scope of the following claims and their equivalents.

Figure 5:
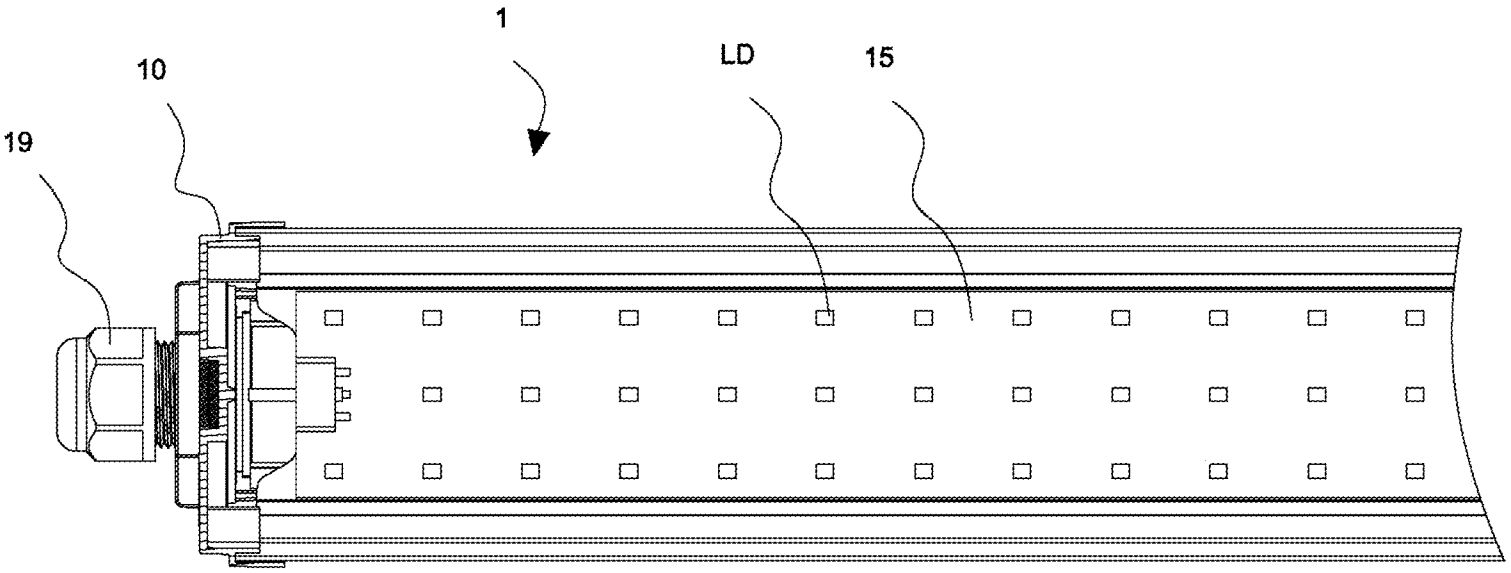
FIG. 5 is a third cross-sectional view of the high-durability tri-proof lamp with color temperature adjustment function in accordance with one embodiment of the present invention.

Please refer to FIG. 5, which is a third cross-sectional view of the high-durability tri-proof lamp with color temperature adjustment function in accordance with one embodiment of the present invention. As shown in FIG. 5, the light source board 15 can be provided with a plurality of light-emitting elements LD. As previously stated, the tri-proof lamp 1 can have the color temperature adjustment switch 18. If the light source board 15 is designed to have two color temperatures, the user can switch the tri-proof lamp 1 between the two color temperatures via the color temperature adjustment switch 18. If the light source board 15 is designed to have only one color temperature, the user can alternatively turn on these light-emitting elements LD in order to increase the service lives of these light-emitting elements LD (the long service life mode).

Besides, in another embodiment, the tri-proof lamp 1 can further provide three or more color temperatures for the user, such as 3000 K, 4000 K (3000 K/5000 K/2) and 5000 K, etc. Thus, the tri-proof lamp 1 can be more comprehensive in application and the user does not need to buy many different types of products at a time.

Figure 6:
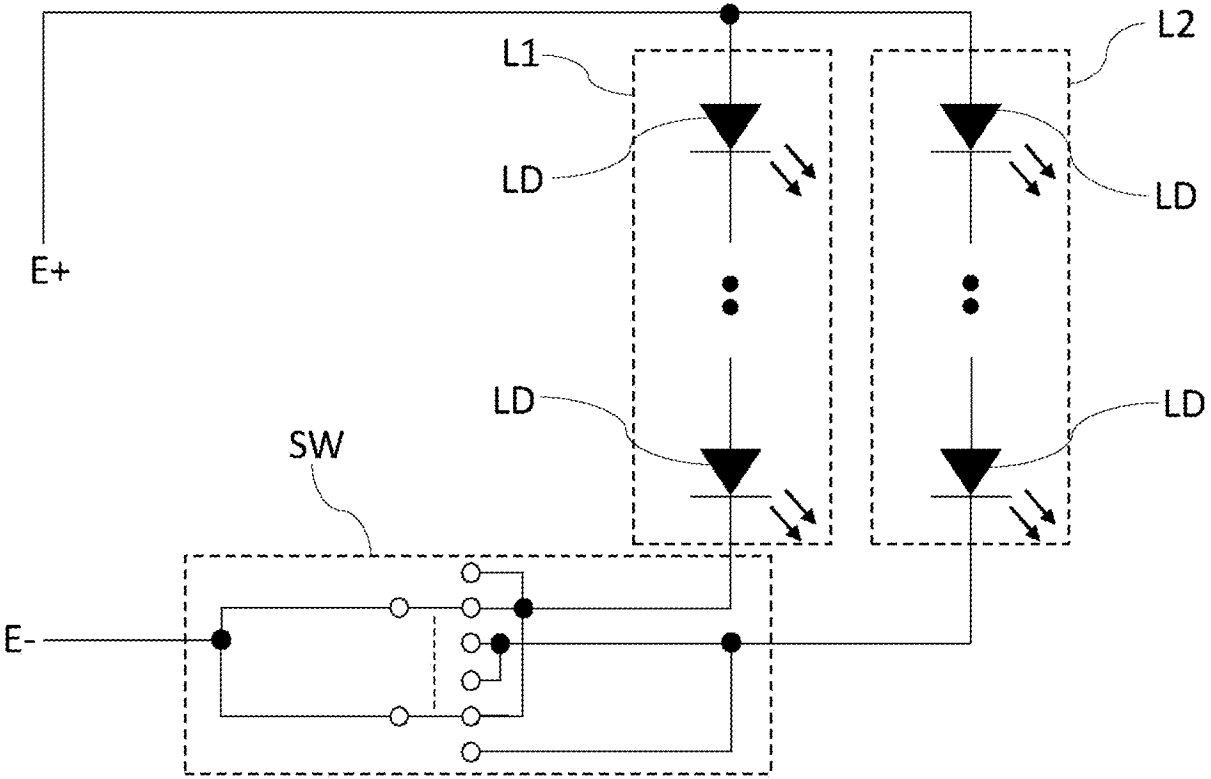
FIG. 6 is a circuit diagram of a color temperature adjustment circuit of the high-durability tri-proof lamp with color temperature adjustment function in accordance with one embodiment of the present invention.

Please refer to FIG. 6, which is a circuit diagram of a color temperature adjustment circuit of the high-durability tri-proof lamp with color temperature adjustment function in accordance with one embodiment of the present invention. As shown in FIG. 6, the circuit board is provided with a color temperature adjustment circuit, which includes a first light source L1, a second light source L2, a switch SW, a (common) positive electrode E+ and a negative electrode E−.

The first light source L1 includes one or more light-emitting elements LD and the second light source L2 also includes one or more light-emitting elements LD. One end of the first light source L1 and one end of the second light source L2 are connected to the positive electrode E+. The other end of the first light source L1 and the other end of the second light source L2 are connected to the switch SW. The switch SW is connected to the negative electrode E−.

The switch SW can be switched to connect one of the first light source L1 and the second light source L2 to the negative electrode E−. When the switch SW is switched to a first state, the other end of the first light source L1 is connected to the negative electrode E− to form a complete loop, such that the first light source L1 is turned on to emit light. Similarly, when the switch SW is switched to a second state, the other end of the second light source L2 is connected to the negative electrode E− to form a complete loop, such that the second light source L2 is turned on to emit light.

The color temperature of the first light source L1 may be different from that of the second light source L2, so the user can change the color temperature of the tri-proof lamp 1 by controlling the switch SW.

The color temperature of the first light source L1 may be the same with that of the second light source L2. Thus, the user can control the switch SW to switch the tri-proof lamp 1 from the first light source L1 to the second light source L2 when the illumination of the first light source L1 decreases due to light decay. Accordingly, the color temperature of the tri-proof lamp 1 can be always constant. The user can also control the switch SW to turn on the first light source L1 and the second light source L2 at the same time. The color temperature adjustment circuit can be provided with three or more light sources in order to provide three or more color temperatures for the user to choose from, such as 3000 K, 4000 K (3000 K/5000 K/2) and 5000 K, etc.

The embodiment just exemplifies the present invention and is not intended to limit the scope of the present invention; any equivalent modification and variation according to the spirit of the present invention is to be also included within the scope of the following claims and their equivalents.

Figure 7A:
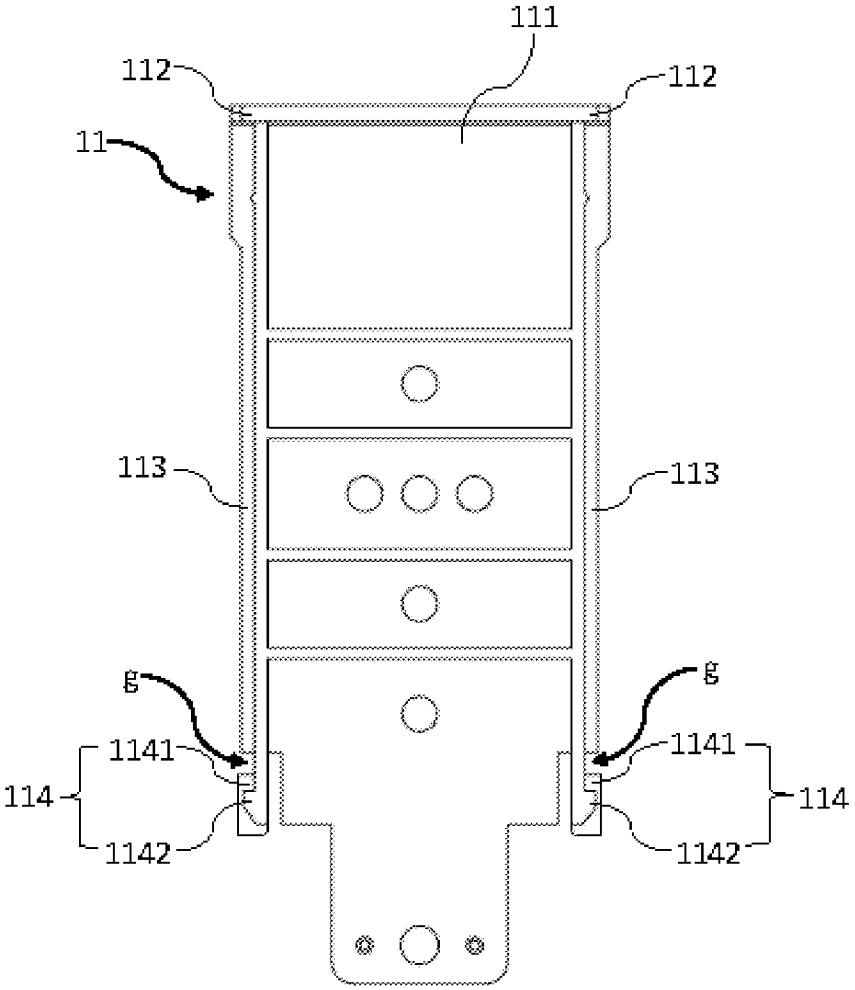
FIG. 7A is a top view of a movable support plate of the high-durability tri-proof lamp with color temperature adjustment function in accordance with one embodiment of the present invention.
Figure 7C:
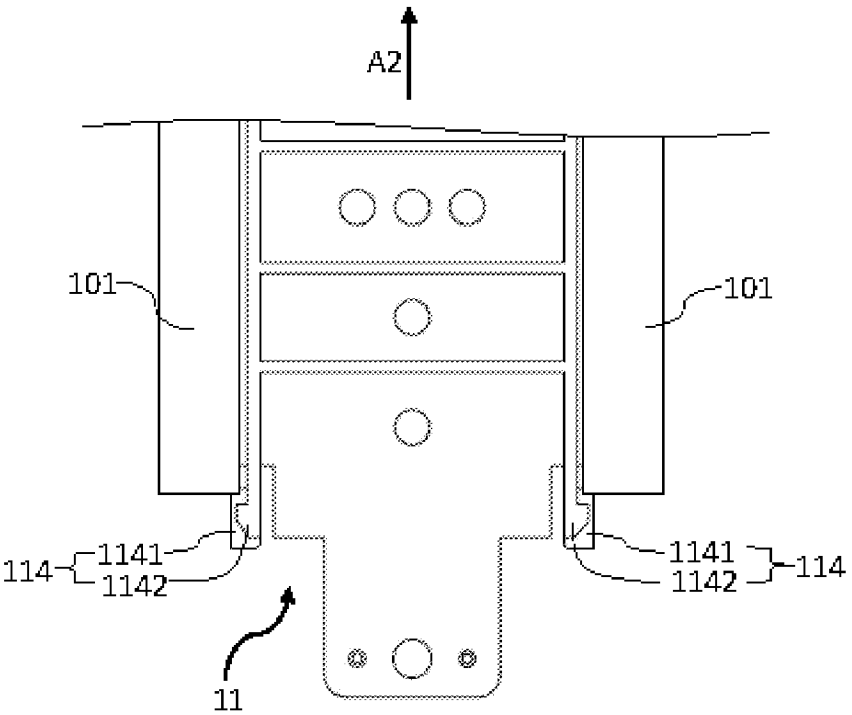
FIG. 7C is a second schematic view of the movable support plate of the high-durability tri-proof lamp with color temperature adjustment function in accordance with one embodiment of the present invention.
Figure 7B:
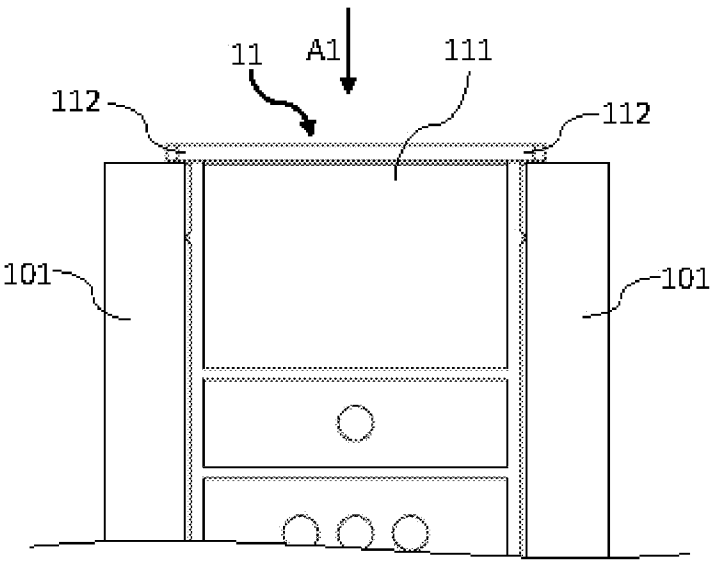
FIG. 7B is a first schematic view of the movable support plate of the high-durability tri-proof lamp with color temperature adjustment function in accordance with one embodiment of the present invention.

Please refer to FIG. 7A, FIG. 7B and FIG. 7C, which are a top view, a first schematic view and a second schematic view of a movable support plate of the high-durability tri-proof lamp with color temperature adjustment function in accordance with one embodiment of the present invention. As shown in FIG. 7A, the movable support plate 11 includes a bottom plate 111, two protrusion blocks 112, two wing portions 113 and two positioning portions 114.

The protrusion blocks 112 are disposed on the bottom plate 111 and at the two sides of one end of the bottom plate 111, such that the movable support plate 11 can move along the guiding groove (including the two lateral guiding slots 101). The positioning portions 114 are connected to the bottom plate 111 and disposed at the two sides of the other end of the bottom plate 111. Each of the positioning portions 114 includes a support plate 1141 and a positioning block 1142, and there is a gap g between the support plate 1141 and the wing portion 113.

As shown in FIG. 7B, when the user pushes the movable support plate 11 into the lamp housing 10 (the direction of pushing the movable support plate 11 is as shown in the arrow A1 in FIG. 7B), the protrusion blocks 112 can avoid that the active support 11 completely enters the inner space of the lamp housing 10.

As shown in FIG. 7C, the positioning blocks 1142 may be a right trapezoid. One end of the positioning block 1142 is a bevel, such that the positioning block 1142 can easily slide into the lateral guiding slot 101. The other end of the positioning block 1142 is a blocking side. Thus, when the user would like to pull the movable support plate 11 from the lamp housing 10 (the direction of pulling the movable support plate 11 from the lamp housing 10 is as shown in the arrow A2 in FIG. 7C), the blocking side of the positioning block 1142 can press against the lateral guiding slot 101, such that the movable support plate 11 cannot be completely moved out of the lamp housing 10. The user should apply more pulling force or pull the movable support plate 11 in a certain angle in order to completely pull the movable support plate 11 out of the lamp housing 10. Further, the gap g between the support plate 1141 and the wing portion 113 can increase the flexibility of the connection structure between the positioning portion 114 and the bottom plate 111, such that the above connection structure is bendable. Therefore, the user can pull the movable support plate 11 out of the lamp housing 10 by applying more pulling force or pull the movable support plate 11 in a certain angle.

The above structure design can effectively prevent the user from accidently pushing the movable support plate 11 into the lamp housing 10 or pulling the movable support plate 11 out of the lamp housing 10 so as to avoid that the movable support plate 11 and the electronic components disposed thereon are accidently damaged. Accordingly, the service life of the tri-proof lamp 1 can be greatly increased.

The embodiment just exemplifies the present invention and is not intended to limit the scope of the present invention; any equivalent modification and variation according to the spirit of the present invention is to be also included within the scope of the following claims and their equivalents.

To sum up, according to one embodiment of the present invention, the lamp housing of the tri-proof lamp is integrated with a movable support plate and a guiding groove. The integrated structure design allows the user to pull a circuit board mounting a driving power source from the lamp housing, such that the driving power source can be moved out of the lamp housing. Thus, the user can conveniently maintain or repair the tri-proof lamp in order to significantly increase the durability (service life) of the tri-proof lamp. Accordingly, the quantities of garbage and the cost can be greatly reduced with a view to conform to the requirements of environmental protection.

Also, according to one embodiment of the present invention, the tri-proof lamp can be easily assembled and disassembled without special tools, so the user can conveniently assemble and disassemble the tri-proof lamp by his/her hands in order to maintain or repair the tri-proof lamp. Therefore, the tri-proof lamp can be conveniently maintained and repaired.

Further, according to one embodiment of the present invention, the tri-proof lamp has a color temperature adjustment switch, so the user can adjust the color temperature of the light-emitting elements of the light source board via the color temperature adjustment switch. Thus, the tri-proof lamp can provide various color temperatures in order to enhance the function of the tri-proof lamp, so the application of the tri-proof lamp can be more comprehensive.

Moreover, according to one embodiment of the present invention, the circuit board, mounting the driving power source, of the tri-proof lamp is I-shaped and the tips of the four protrusion portions of the I-shaped circuit board are rounded, such that the contact area between the circuit board and the guiding groove can be greatly decreased, which can effectively prevent the materials on the circuit board adhered to the guiding groove.

Furthermore, according to one embodiment of the present invention, the structure design of the tri-proof lamp is simple and effective, so can achieve the desired technical effects without significantly increasing the cost. Therefore, the tri-proof lamp can have high commercial value.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A high-durability tri-proof lamp with color temperature adjustment function, comprising:

a lamp housing, having two connection holes and a guiding groove, wherein the lamp housing is hollow, a chamber is formed therein and the connection holes are disposed at two ends of the lamp housing respectively, wherein the guiding groove comprises two lateral guiding slots disposed at two sides of the chamber respectively;

a movable support plate, disposed in the chamber, wherein one side of the movable support plate and the other side of the movable support plate are inserted into the lateral guiding slots respectively, whereby the movable support plate is able to move along the guiding groove;

a circuit board, disposed in the chamber and connected to the movable support plate;

a driving power source, disposed on the circuit board and electrically connected to the circuit board; and a connector disposed on the movable support plate and electrically connected to the circuit board, wherein the connector is electrically connected to an external power source.

2. The high-durability tri-proof lamp with color temperature adjustment function as claimed in claim 1, further comprising a light source board electrically connected to the circuit board and disposed in the chamber.

3. The high-durability tri-proof lamp with color temperature adjustment function as claimed in claim 2, further comprising a color temperature adjustment switch disposed in the chamber and electrically connected to the light source board.

4. The high-durability tri-proof lamp with color temperature adjustment function as claimed in claim 2, further comprising a light diffuser covering at least a portion of the lamp housing, whereby a light emitted by one or more light-emitting elements of the light source board passes through the light diffuser and the lamp housing.

5. The high-durability tri-proof lamp with color temperature adjustment function as claimed in claim 2, further comprising a light reflecting plate disposed in the chamber and the light source board is fixed on the light reflecting plate.

6. The high-durability tri-proof lamp with color temperature adjustment function as claimed in claim 1, wherein the circuit board is fixed to the movable support plate via a fixing element.

7. The high-durability tri-proof lamp with color temperature adjustment function as claimed in claim 1, wherein the circuit board has a color temperature switching circuit, and the color temperature switching circuit comprises a first light source, a second light source, a switch, a positive electrode and a negative electrode, wherein one end of the first light source and one end of the second light source are connected to the positive electrode, and the other end of the first light source and the other end of the second light source are connected to the switch, whereby the switch is switched between a first state and a second state to connect the other end of the first light source to the negative electrode or connect the other end of the second light source to the negative electrode.

8. The high-durability tri-proof lamp with color temperature adjustment function as claimed in claim 1, wherein the circuit board has four protrusion portions, such that the circuit board is I-shaped, wherein tips of the protrusion portions are rounded and the protrusion portions are inserted into the lateral guiding slots respectively.

9. The high-durability tri-proof lamp with color temperature adjustment function as claimed in claim 1, further comprising two removable water-proof caps disposed on the lamp housing and configured to cover the connection holes respectively.

* * * * *